US006138776A

United States Patent [19]

Hart et al.

[11] Patent Number: 6,138,776

[45] Date of Patent: Oct. 31, 2000

[54] POWER TONGS

[76] Inventors: Christopher A. Hart; David N. Cannan, both of 903 Hodgkins, Suite 104, Houston, Tex. 77032

[21] Appl. No.: 09/234,333

[22] Filed: Jan. 20, 1999

[51] Int. Cl.[7] ..... E21B 19/14

[52] U.S. Cl. ..... 175/85; 166/77.5; 81/57.16

[58] Field of Search ..... 166/77.4, 77.53, 166/77.51, 78.1, 379, 380; 175/52, 85, 171; 81/57.34, 57.16, 57.2, 57.35, 57.17, 57.18

[56] References Cited

U.S. PATENT DOCUMENTS

| | | | |
|---|---|---|---|
| 3,803,953 | 4/1974 | Geczy et al. | 81/57.36 X |
| 4,295,527 | 10/1981 | Russe | 166/315 |
| 4,348,920 | 9/1982 | Boyadjieff | 81/57.25 |
| 4,479,537 | 10/1984 | Reed | 166/77 |
| 4,974,686 | 12/1990 | Hisey et al. | 173/164 |
| 5,092,399 | 3/1992 | Lang | 166/77.5 |
| 5,123,484 | 6/1992 | Bode | 166/85 |
| 5,388,652 | 2/1995 | Smith | 175/85 |
| 5,931,231 | 8/1999 | Mock | 166/377 |

OTHER PUBLICATIONS

CLINCHER Hydraulic Power Tongs and Back–up brochure, thought to be 1993.

The Clincher Drillmaster brochure, undated.

The Clincher Drillmaster brochure, shown with 550 H Hawk Spinmaster—undated.

CLINCHER 135 Make/Break Tool, undated brochure.

Eckel Hydraulic Power Tongs, Catalog 1986–1987.

FARR Hydraulic Power Tong Equipment and Accessories brochure, undated.

*Primary Examiner*—Robert E. Pezzuto

*Attorney, Agent, or Firm*—Felsman, Bradley, Vaden, Gunter & Dillon, L.L.P.

[57] ABSTRACT

A pipe handling system comprises a rig floor supported frame adapted to be positioned above the rotary table and in alignment with the hole in the rotary table. It incorporates a centrally located bowl lined with the frame to enable a string of pipe to extend through the rotary table. Appropriate releasable slips are moved into and out engagement. The frame supports an overhead mounting plate, and one version thereof it incorporates hydraulic jacks to raise and lower the mounting plate. The mounting plate supports a horizontally directed hydraulic ram which moves the two end lengths of a long multi length chain looped into a bight to go around a pipe passing near the end of the mounting plate. The bight in the chain grips the coupling of the pipe to hold it fast. This mechanism cooperated with an overhead power tong assembly to enable threading or unthreading of pipe casing and tubing.

17 Claims, 4 Drawing Sheets

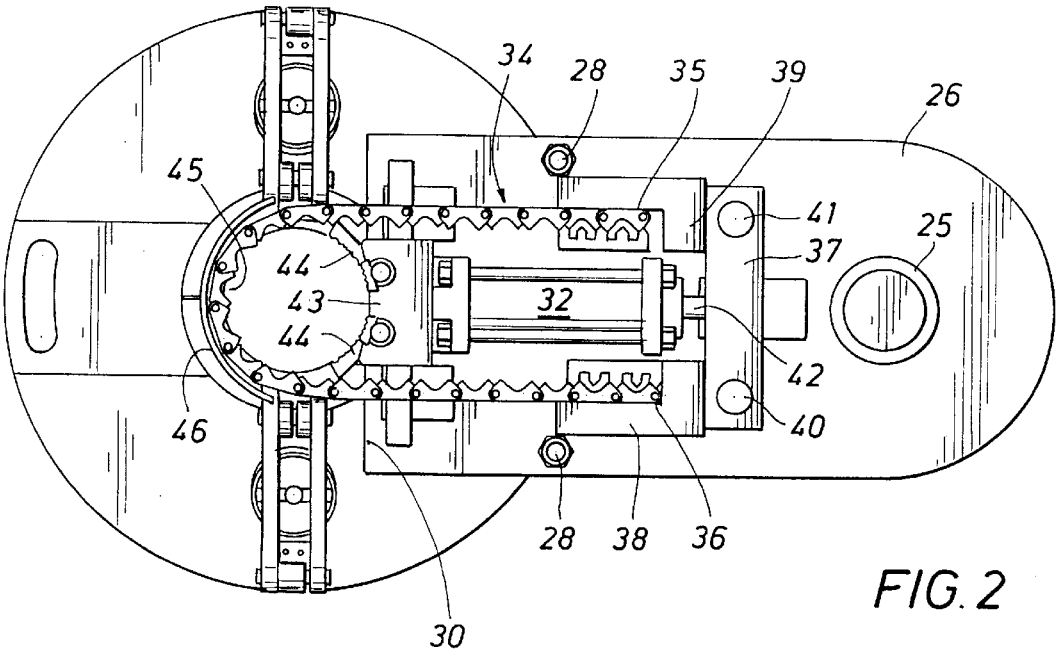
FIG. 2
FIG. 1
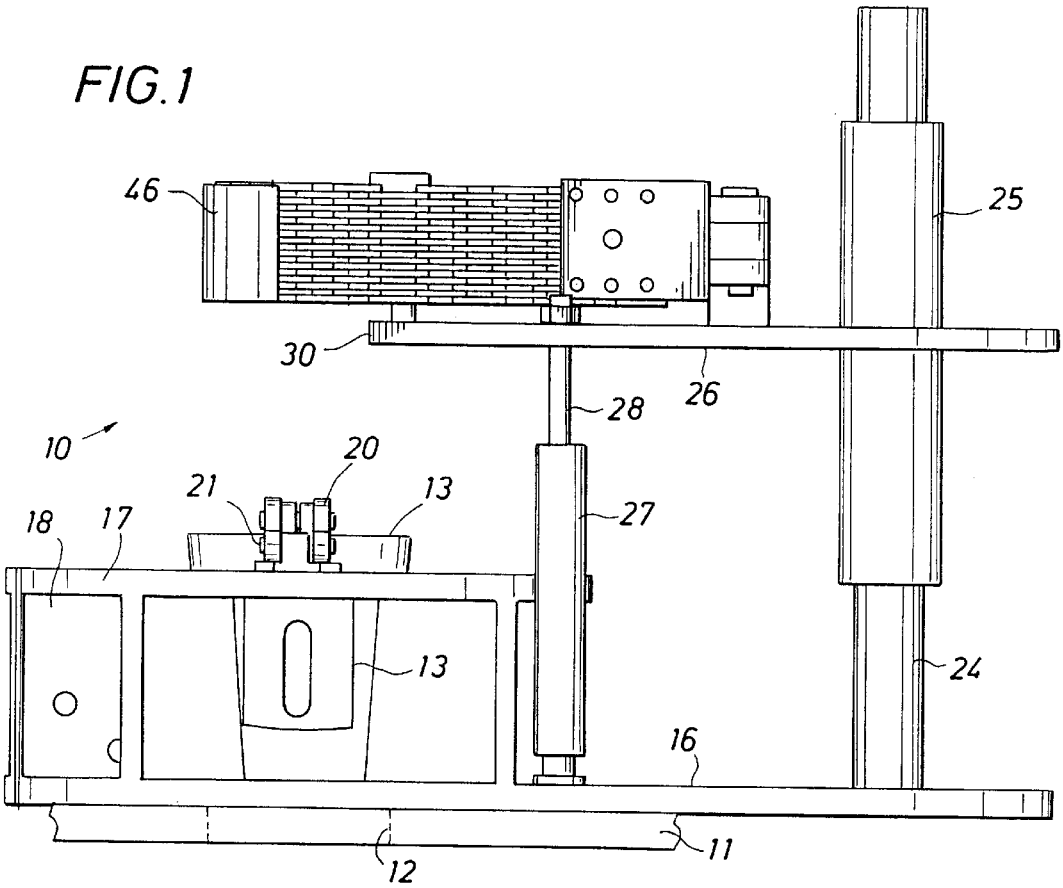

POWER TONGS

BACKGROUND OF THE DISCLOSURE

In the handling of a string of casing, drill pipe or tubing, it is necessary to thread the pipe joints or sections together. As used in this disclosure, the term pipe joint will refer to one joint or length of drill pipe, commonly thirty feet in length. Many pipe systems comprise threaded pin and box connections. The pin and box connections thread together. The drill string is normally assembled so that rotation to the right (during the drilling process) tightens up the threads at the pin and box connections. They can become so tight that it is necessary to loosen then with power tongs. Hand powered tongs once were used on many rigs and are still sometimes available but the power tongs have partially replaced them. They can also become so tight that it is necessary to supply a controlled amount of torque to the threaded joint to make the disconnection. In like fashion, it is necessary to tighten the threads controllably when making up the string of pipe. While this is common in a drill string, it is also necessary in the event of threading several sections of pipe together to form a casing string. While the size of the pipe may differ, and the threads may differ in some detail, all of these procedures require controlled threading and unthreading. Controlled threading and unthreading must be done simultaneously while supporting the string of casing or the drill pipe hanging below the surface. In fact, several tons of pipe comprising several thousand feet of pipe may be suspended below the drilling rig rotary table. This is normally rested in the rotary table. The rotary table is equipped with a central opening. This opening is normally a rectangular opening to engage the kelly which is stabbed through the opening so that the rectangular opening engages the external profile of the kelly to impart torque to the pipe string. Sometimes, however, that opening is replaced with a different kind of opening which is known as a bowl and the bowl is partially blocked up with a set of slips (usually several slips) which collaborate to grab a pipe extending through the bowl.

The bowl is larger than the pipe, but the space between the bowl and the pipe adjacent to it is filled by the wedge shaped slips. Moreover, the slips are positioned to encircle a pipe and clamp against the joint. The coupling defines a thicker pipe length between the spaced shoulders where the downwardly facing shoulder is secured above the bowl. While several thousand feet of pipe will hang below the bowl, the open upper end of the pipe string enables threading at that location.

In times past, roughnecks on the rig floor have used a set of tongs to grab the pipe, grip the pipe and make or unmake a threaded joint. With a long drill string suspended in the well borehole, and with all the weight that is on it, it is often possible to count on the massive inertia of that weighty string of pipe to prevent unintended rotation when threading or unthreading a joint of pipe. With a typical set of elevators, the next joint of pipe is removed from the mouse hole, suspended in the derrick and stabbed into the top most open end of the pipe string using a set of tongs to rotate this pipe joint (weighing perhaps 600 pounds) to be threaded to the pipe string which may weigh 100 times greater. That is an acceptable procedure.

All the procedures which have been used heretofore have featured spinning chains, perhaps fifty years ago, and pipe spinners, perhaps thirty years ago and power tongs which have replaced the spinning chains and which are intrinsically safer. There are occasions in which first and second power tongs are used together. One set of tongs will grasp and hold the pipe above the threaded connection while the lower set of "tongs" will grasp and hold the pipe joint for that connection. In that instance, one of the power tongs will rotate while the lower unit will simply grasp and hold the pipe. The latter tongs are commonly called the backup tong. Since the upper tong is powered, the other tong simply provides a stationary grip on the pipe, fixing it so that it holds still while rotation is applied on the other side of the threaded joint.

A good deal of coordination is required to work two sets of pipe equipment, commonly the power tong and the backup (more or less equal in weight and size). Moreover, these two "tongs" typically are so large and heavy that they have to be suspended from some sort of overhead chain or pivot to enable service personnel on the rig floor to handle them. The workmen (known as roughnecks) are engaged in a dangerous enterprise when they have to grab or wrestle a chain suspended set of tongs, move them over towards the center line position (defined by the rotary table) and then position the power tongs for grasping the pipe. This problem is true both for light weight hand operated tongs as well as motorized tong systems. It is twice the problem if there are two sets of tongs. Partly, the two sets of tongs must be moved in a synchronized fashion to engage and grasp the pipe string. When that is done the coordination is difficult, the work is hard, the risk is increased, and operator errors become more commonplace. The power tong units weigh several hundred pounds. When there are two of them, it is possible to suspend the bottom "tongs" from the upper tong. That leaves the personnel on the rig floor moving a different amount of weight which is troublesome in the extreme. The weight that must be handled poses a good deal of struggle which, in the best of circumstances is hard and difficult work. In the worst of circumstances, the floor is wet and slick, the pipe may be crooked or bent, and the amount of torque required from the tong will vary from joint to joint. Also, there is always the human operator problem, namely that the threaded joint may be stopped about 20 inches above the rotary table, and then the next occasion may involve stopping 40 inches above the rotary table. Because this height will vary, the tongs have to be engaged with the pipe at different heights, and that requires vertical movement as well as lateral movement to bring the tongs into operative position.

There is a coordination requirement between tong movement and installation of the slips in the bowl. The physical location of these jobs poses something dangerous to nearby personnel. It is easy to get a hand or arm pinched, and it is not unusual to see roughnecks missing one or two fingers. It is even a little bit more difficult if it is done aboard a drill vessel which may rise and fall with wave action, as for example in a semisubmerssible rig. All these factors create difficulties.

In one aspect, the present invention is an improvement over a pair of independent, suspended power tongs in a drilling rig. Without belaboring the point, the roughnecks must maneuver both sets of tongs so that they are aligned with the pipe notwithstanding the height of the pipe extending above the slips and bowl, and must do this with both straight and crooked pipe.

The present disclosure reduces the weight and heft of this system by anchoring the lower tong (below, it is called the backup mechanism) on a platform which surrounds the bowl, and which incorporates the appropriate slips which are stabbed into the opening. The suspended weight is reduced more or less by 50% by doing this. If each set of tongs weighs 400 pounds, this is a sizable reduction is the movable weight. Moreover, it locates the HB system in alignment with the slips and rotary bowl. In the present disclosure, a framework sits near and in alignment with the bowl. It supports a set of slips which are mechanized for insertion into the bowl. All of this is located on a framework having the shape of a donut with the bottom plate bearing against the rotary table and with the top plate elevated thereabove. The top plate pivotally supports a set of slips. This enables the slips to be easily positioned. Above and in axial alignment, the lower H B assembly is supported on the framework. The lower tong assembly is optionally raised or lowered. The H B is anchored on the frame and therefore it is not a heavy item to be forced into the axial pathway of the pipe. It is located at that location so that it can reach out and grab the pipe below the coupling to enable the pipe to be engaged with the bowl and slips.

The present disclosure sets out the HB mechanism which is self aligning with respect to the pipe. It reaches out to grab and hold the pipe notwithstanding movement of the pipe to the left or right. The range of reach is adjustable so that it can accommodate relative movements. The lower assembly accomplishes hydraulic alignment below the coupling. This is on a tubing spider which is installed on the rotary table. Effectively, through the use of an automated power tong thereabove, it provides greater speed going in or out of hole. It can be done with a large casing, standard size drill pipe and even with small tubing such as will be installed during a well completion process. Better than that, it can be operated somewhat remotely so that the personnel do not have to get into the limited floor area between the four legs of the derrick. This cuts down on crowding. This also permits a reduction of personnel in that vicinity so that there are fewer people exposed to the danger. This is equipment that can be conveniently used to provide control threaded torque in making or breaking a threaded joint. This especially is effective as a backup tong and also as a moveable pipe clamp mechanism. It can be used on equipment located on land or sea. It is effective also to accomplish clamping, thereby securing the pipe against any unintended movement at or during threading operations.

SUMMARY OF THE PRESENT APPARATUS

The present apparatus is summarized as incorporating a framework which is adapted to be placed on the rig floor and to extend over the rotary table. It incorporates a fixed framework which aligns with the rotary table and the opening in it. The framework supports a bowl with a cooperative set of removable slips. The slips, when positioned in the bowl, include inserts which grasp and hold the wall of a pipe in the bowl. With appropriate slip selection, it can grasp the smallest tubing up to the largest casing extending through the bowl. This slip assembly holds the string suspended in the well borehole to prevent dropping the drill string, and to hold against the weight of the drill string.

The frame supports a plate extending from the side and directed towards the pathway of pipe passing through the bowl and slips just mentioned. This locates a clamp chain which encircles the pipe. The chain is grasped around the exterior on the pipe. Preferably it grabs the pipe at a selected location i.e. the collar which is made of thicker stock. The plate supports a hydraulic ram which engages the two ends of the chain and pulls the chain loose or tight as the case may be. The chain encircles and contacts a portion of the collar while the collar is pulled over against a plate mounted upstanding V-shaped set of dyes which define the stop for the pipe. By appropriately opening and closing the chain, the pipe is engaged or released. In one version, this mechanism is located on a set of hydraulically operated rams which raise and lower the clamp.

The slips cooperative with bowl grasps and hold the pipe against vertical movement to thereby suspend the string. The chain reaches around the collar at the end of the pipe to prevent rotation. Effectively, this serves as a backup mechanism to prevent slippage when a joint is threaded or unthreaded from above using a pivotly mounted chain suspended power tong mechanism.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view of the preferred embodiment of the backup tong mechanism cooperative with a set of slips and bowl and mounted for adjustment with respect to a tubing to clamp and hold the tubing;

FIG. 2 is a plan view of the structure shown in FIG. 1 illustrating added details of the HB tong mechanism;

DETAILED DESCRIPTION OF THE PREFERRED EMBODIMENTS

Figure 3:
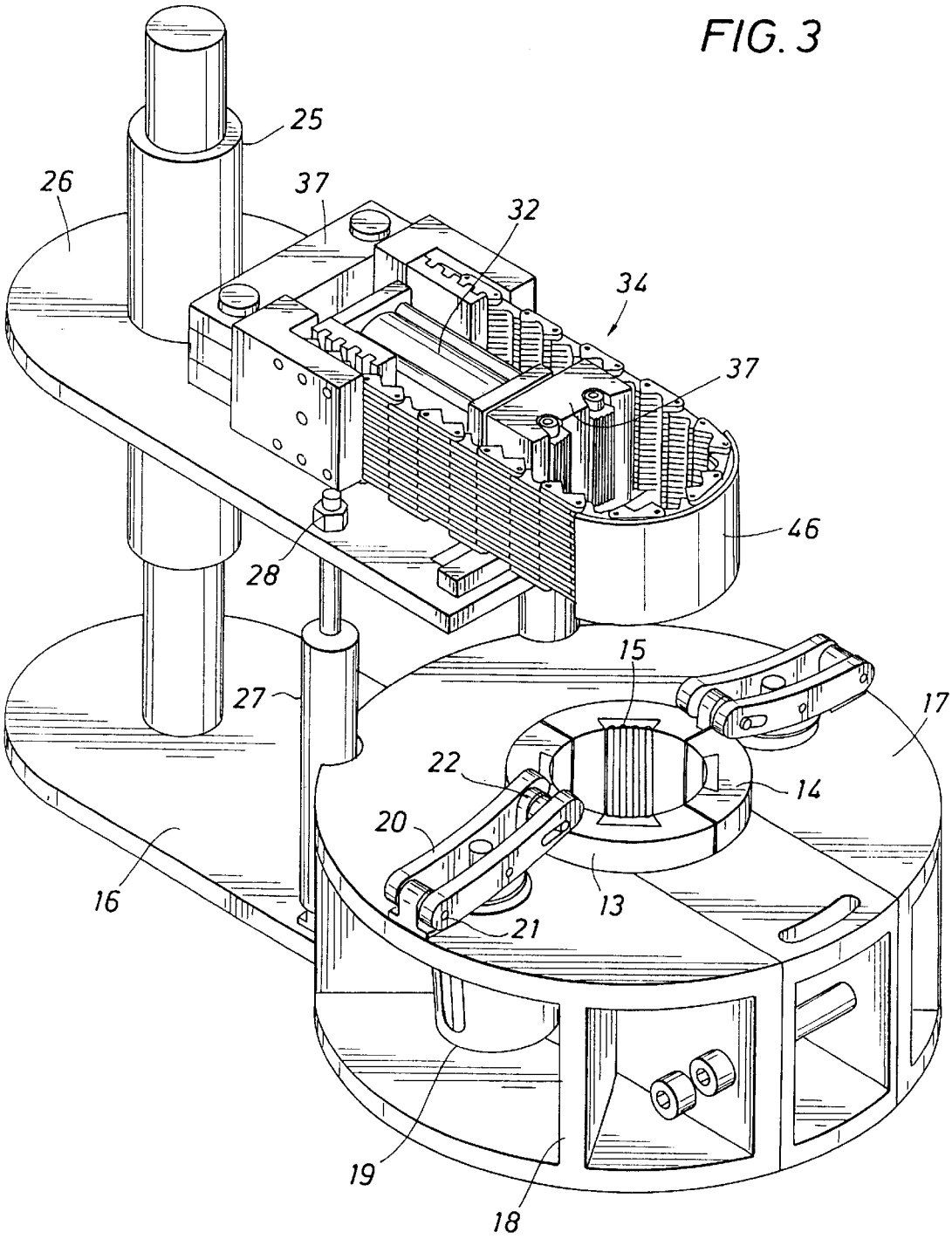
FIG. 3 is a perspective view of the structure shown in FIGS. 1 and 2 showing added details of the system.

Attention is now directed to FIG. 1 of the drawings which shows the system 10 (including the HD as will be described) of the present disclosure constructed for mounting on a drilling rig. More specifically, it is supported above a rotary table 11 which is driven by a very large power plant to rotate in a direction suitable for turning or rotating the drill bit. The rotary table 11 includes an opening in it which is represented in dotted line at 12. The opening 12 is located immediately above and axially aligned with a bowl 150 which is provided with one or more slip segments 13 which are moved downwardly into the bowl and which taper on the outer face so that they wedge into the bowl and define an encircling grip 14 (see FIG. 3) which is sized to reach under a protruding shoulder on a pipe string. Commonly, the pipe sections are constructed with pin and box endings enabling threading into adjacent joints. Pipe joints are normally constructed with an external shoulder. The external pipe shoulder faces downwardly from above the encircling grip 14, which faces vertically upward. This encircling grip 14 clamps against the pipe joint.

The several slip segments 13 which cooperate with one another define a circle which is larger than the pipe. The slip segments 13 are individually mounted so that they each individually wedge in against the pipe, and collectively form the grip 14. The grip 14 is interrupted with a number of frictional inserts 15. These are inserts which are mounted in undercut grooves. They are wear elements having a set of teeth which project outwardly to grasp or grip the pipe placed in the slips. When worn, they can be replaced without discarding the individual tapered slips.

It is this encircling grip 14 which contacts the pipe on the outside surface of the pipe with the inserts 15. Moreover, a pipe joint which is supported at this location is then held so that a full length string of pipe (ranging from the smallest tubing up to the largest casing) hangs into the well borehole.

Going back to FIG. 1 of the drawings, a tubing spider is defined by the structure and comprises the bottom plate 16 and the parallel upper plate 17. These plates are spaced apart by a set of radial ribs 18. The ribs 18 are clustered around the bowl. The ribs 18 extend radially inwardly toward the center line axis of the pipe. They define a gap which is between the parallel plates 16 and 17 to receive a pneumatic or hydraulic piston and cylinder unit 19 (FIG. 3). The unit 19 has a central pin which extends and retracts. In turn, that works with a dual link coupling 20. The coupling is anchored at the outboard end to the pin and clevis 21. At the inboard end, it connects with a rotatable link including a perforated tab 22 to thereby enable the clevis mounted link coupling 20 to rotate. As viewed in FIG. 3 of the drawings, the link coupling 20 rotates around the pin and clevis 21, thereby lifting the opposite end and pulling one of the slips out of the bowl. Each slip is raised and pulled away. It is pulled upwardly and out of connection. When pulled, it is no longer available for locking against the pipe. In the preferred embodiment, this kind of extraction mechanism is located on the left and right so that there are two slips which are pulled away. It can just as easily be replicated so that powered extraction mechanisms are used for all of the slips, the preferred embodiment using four slips to define the circle, and the preferred embodiment utilizing preferably four of the fluid mechanisms which, on achieving low pressure, can be returned to the illustrated position or on high pressure, can be extended upwardly for slip disengagement.

Going back to FIG. 1 of the drawings, it will be observed that the bottom plate 16 extends some distance out to the side. This enables an upstanding post 24 to be anchored to it. That post in turn guides a sleeve 25 which moves upwardly and downwardly. The sleeve 25 is moved in telescoping motion as will be described. The sleeve 25 is connected with an upper mounting plate 26. The plate 26 extends outwardly and is parallel to the plate 16. These two plates are held apart by a double acting hydraulic piston and cylinder arrangement indicated generally at 27. This arrangement includes a protruding piston rod 28 which operates the plate 26, moving it upwardly or downwardly. On movement, the plate 26 remains parallel to the bottom plate 16. On movement, the plate is not canted, but remains parallel to the plate 16. While hydraulic power is provided to the cylinder 27, both for raising and lowering, movement is guided by the sleeve 25 around the post 24. While that could be made into a powered mechanism, it is preferably not needed because movement is assured without becoming canted or misaligned. Effectively, the long sleeve 25 provides an alignment function as well as a support function. This assures proper movement of the HB is carried on the plate 26 as will be described.

The plate 26 is the mounting plate for a hydraulically operated pipe backup mechanism. The plate 26 is shown better in FIG. 2 of the drawings. That also shows the sleeve 25 which enables telescoping movement upwardly and downwardly. In addition, it shows the piston rod 28 which extends through the plate 26 and anchors to it. In conjunction with that, there is a second and duplicate hydraulic cylinder which is obscured in FIG. 1 of the drawings. As illustrated in FIG. 1 of the drawings, the plate 26 extends outwardly to an edge 30 which defines the mount for the nonrotating backup mechanism. Going into specific details, the plate 26 features a hydraulic cylinder and piston 32 which is shortened or elongated. When it moves, it changes the tension in a chain 34. The chain 34 straps around the pipe, and has spaced ends 35 and 36 which are located on opposite sides of the hydraulic cylinder. The spaced ends 35 and 36 are anchored to a mounting plate 37. The ends of the chain are connected with transfer links having the form of L-shaped brackets 38 and 39. The brackets 38 and 39 are symmetrical, fastening by pivot pins 40 and 41 to the plate 37. All of this mechanism is pushed to the right as viewed in FIG. 2 of the drawings to thereby tighten the chain. This movement occurs when the piston rod 42 is extended. When retracted, the chain is made slack. The chain loops around a semicircular shoe 43 which supports angled inserts 44. The angled inserts 44 are set to a V-angle thereby providing a curving face. The curving face is fixed to the plate 43. In turn, that plate is anchored with respect to the mounting plate 26.

As viewed in the plan view of FIG. 2 of the drawings, the plate 43 is stationary and does not move. The angled inserts 44 are set at an angle to enable gripping. This is a part of the fixed shoe 43 which does not move. It is anchored to the plate 26, and the hydraulic cylinder 32 is also anchored to it, thereby pushing to the right side of FIG. 2 of the drawings to make the chain 34 tighter. The chain 34 has a number of links with selected links 45 on the interior, positioned to grip and hold the pipe in conjunction with the inserts 44. The exterior of the chain is wrapped by a shield 46 which is mounted on it. The shield 46 assures that the links do not sag or become misaligned.

The shield 46 is externally on the chain which is formed of several links, measured vertically, as better shown in FIGS. 1 and 3 as the drawings. Pulling the chain to pull tight or snug is accomplished by moving the piston rod 42 towards the right on extension. When the chain is relaxed, this is accomplished by retracting the piston rod 42, and that opens the mouth or light of chain to a greater measure. The chain is sized to reach around a pipe and hold the pipe when pulled.

Reviewing what has been described so far, the entire mechanism on the plate 26 serves as a non rotating tong which grips and holds the pipe. In common operation, the pipe is positioned so that it extends upwardly through the bowl and slips which are at the bottom, thereby grabbing and holding the exterior of the pipe. By appropriate arrangement of the HB system, the pipe is gripped when held against vertical movement by the slips and cooperative bowl. Assume for an easy example that a pipe is positioned in the bowl and slips and held with two feet of pipe extending above the slips. The slips are set, and weight is permitted to shift the pipe downwardly ever so slightly. When it moves downwardly, the inserts 15 are firmly engaged on the outer wall of the pipe. The coupling on the pipe preferably is arranged several inches above the bowl and slips. Preferably it is located so that the coupling is high above the bowl and slips, and is even with the chain 34. This enables the pipe to be gripped by the chain in that region. This is a rugged metal area which does not scratch or scar readily. It is also thicker and can stand the hoop stresses inflicted on it by the chain when it is pulled tight.

On pulling the pipe snug by tightening the chain around it, a crushing force can be applied. It is preferable to enable, gripping at the desired location on the pipe string. Again, some of this is accomplished by by raising and lowering the plate 26 on the hydraulic cylinder 27.

Figure 5:
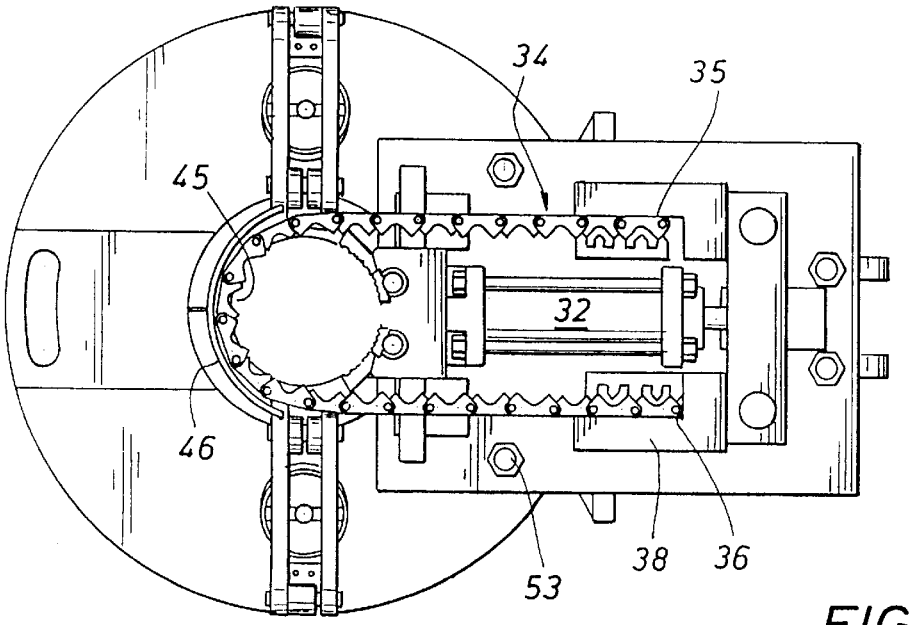
FIG. 5 is a plan view of the alternate embodiment shown in FIG. 4.
Figure 4:
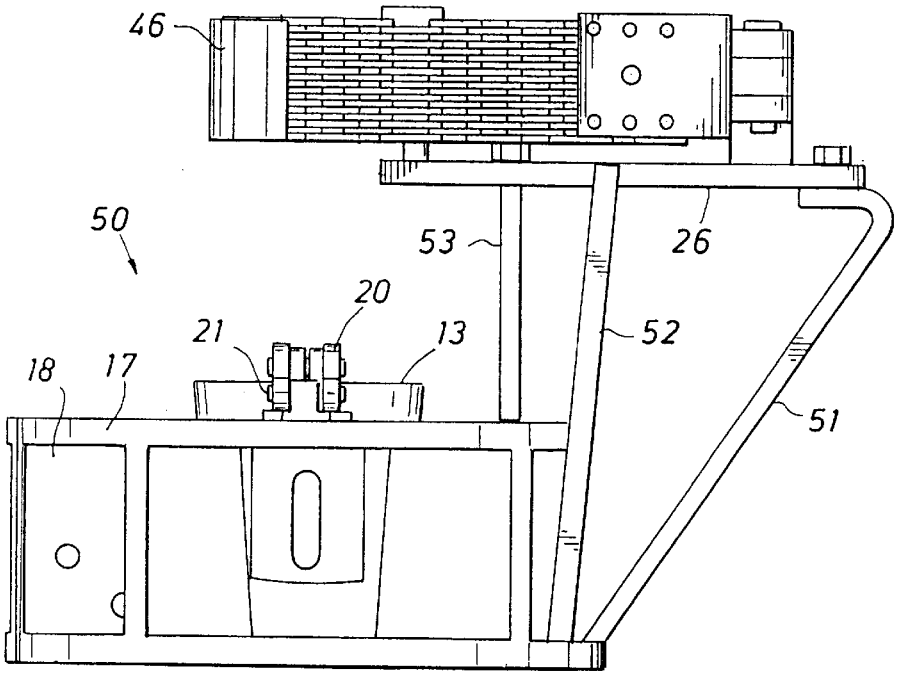
FIG. 4 is a side view similar to FIG. 1 showing an alternate embodiment.

While this describes the embodiment 10 shown in FIGS. 1, 2, and 3, there is another embodiment which is indicated by the numeral 50 (see FIGS. 4, and 5) which does not move upwardly or downwardly. The embodiment 50 uses the same type slip and bowl mechanism. The embodiment 50 also uses the common mounting plate 26. In this particular instance, the mounting plate 26 cannot be raised or lowered. The height of it is fixed by the supporting framework underneath which includes the upstanding pair of frame members 51 plus a sloping mounting plate 52. The mechanism also includes the upstanding threaded bolt 53. It is included to provide another interconnection so that the plate 26 is held substantially stationary.

Figure 6:
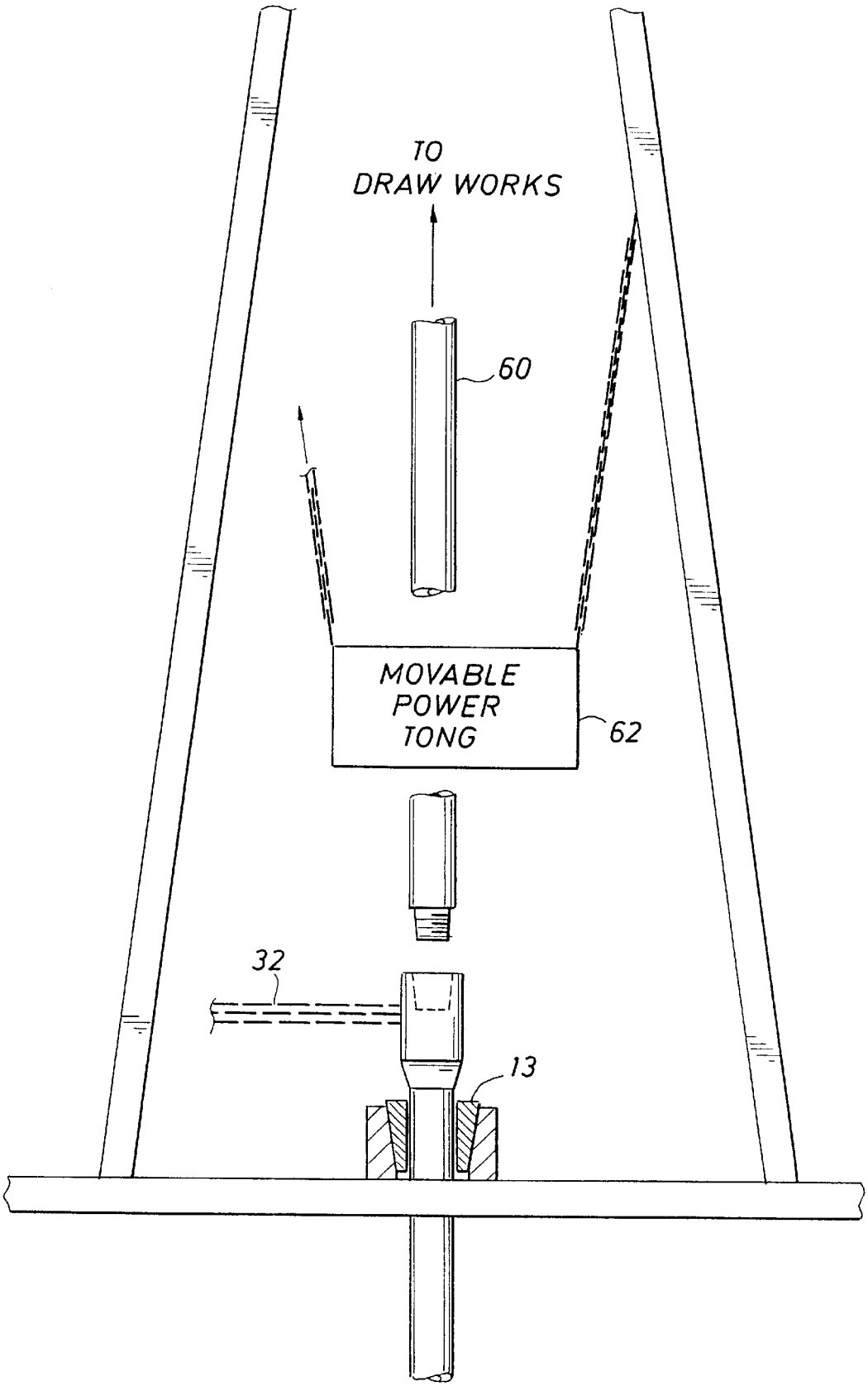
FIG. 6 is a schematic view of the apparatus of the present disclosure in operation.

FIG. 6 is a schematic showing the engagement of a string of pipe which can just as readily be a drill string or a casing string, and if desired a tubing string. At the bottom, the schematic represents the rotary table. Just above it, and functionally tied to it, there is the grip region which is accomplished by the bowl and slip segments 13. These grab the exterior of the pipe. They hold up the weight of the pipe string therebelow. They are underneath the threaded coupling area, giving enough clearance so that it can be grasped and held in a way to be described.

As illustrated in FIG. 6, the chain 34 is looped around the pipe and holds snugly on the pipe. Preferably this holds in the region which is known as the coupling. It is larger and thicker in that region. The coupling area is held by the mechanism which is telescoped in movement up or down to catch up with the coupling. Again, holding in this region, the pipe is now fixed so that the weight of the pipe string is held up (by the slips in the bowl) and rotation is prevented by the grip of the backup tong mechanism. The hydraulic backup mechanism defeats rotation, and when pulled tight, it holds around the coupling and does not permit any rotation.

The schematic also shows the next pipe 60 which is rotated with a set of power tongs. These power tongs 62 are shown in schematic form and they are suspended from an overhead cable or chain connected about 10 to 20 feet up the derrick leg. This cuts down the amount of weight which is swinging to and fro. More than that, it also locates that weight relatively high so that it is out of the way of operation of the backup mechanism which is shown in FIG. 1. Not only that, it is located so that it is able to grasp and hold while imparting rotation while the apparatus at 10 (see FIG. 1) does not rotate, and just simply grabs and holds. Following this logic, the manner in which the pipe 60 is held is important to the durability of the pipe string and the ease of installation and removal.

Continuing with the schematic drawing, the power tongs, indicated generally at 62, are rotated in either direction. They can rotate one way to thread the pipe and the other way to unthread the pipe. This is done repetitively in the right direction to assure clamping of the top most pipe 60. There is no limit on the torque resisted by the fixed or stationary backup mechanism. There is ordinarily a limit to the torque applied through the motorized power transmission system.

Considering now the sequence of adding a pipe joint, assume that the illustrated top pipe joint 60 is initially resting in the mousehole. The draw works are disconnected from the drill string by breaking the drill string at the kelly. To do this, the drill string has to be supported in the bowl and slips. All of that is accomplished as a preliminary to being able to clamp and hold the drill string. In other words, the drill string weight is usually several thousand pounds of dead weight. This weight has to be appropriately supported, hence, the weight is shifted in the bowl to the slips. Moreover, this is an appropriate sequence for holding the drill string so that it does not slip into the partially completed well borehole. With the slips holding on the wall of the pipe (casing or tubing), the hydraulically powered backup grabs the thicker coupling.

On review of the written specification above, it will be understood in FIG. 6 that the slip segments 13 hold against vertical movement while the chain 34 holds against rotational movement. Preferably the chain is made of several links across the width of the chain. That prevents the chain from sagging or hanging limply. In this instance, the chain is constructed more in fashion of a bicycle chain which is able to bend in one dimension but not at right angles to that dimension. The chain is preferably several links in width so that it grasps the thicker part of the pipe which is known as the coupling. In that region, there is more metal and therefore there is greater strength for handling the hoop stresses which are applied at that area. This assures that the pipe string supported in the slip segment 13 does not rotate. This more than enhances the inertia of the weighty and heavy pipe string to prevent movement when the top most joint is threaded or unthreaded.

This arrangement can be used when going into the hole and coming out of the hole. Going into the hole, assume that the pipe string is a casing string. Joint after joint is added at the top. It is then lowered into the well borehole by raising and lowering the draw works appropriately. For each operation, the overhead and movable power tongs grasp the joint 60, spin it in the right direction to make the threaded connection, and apply controllable torque to get the joint threaded as desired. Later the tongs 62 are disengaged and removed, pushing the tongs 62 to the side. The pipe string is then held by the draw works. By lifting up on the draw works, simultaneously loosening the chain 32, the string can be raised an inch or two to dislodge the slip segments 13. They are then pulled from the wedge located engagement illustrated in FIG. 6. Then, the entire string of pipe is lowered in the well borehole. This feeds in a length approximately equal to the joint 60 which is added above the bowl. Once the drill string or pipe string has been lowered to their desired depth, it is again rested on the slips by repositioning the slip segments 13 in the illustrated position of FIG. 6 to grab the exterior of the top most pipe. Now, that is the joint 60. The chain 34 is tightened around the coupling that is brought even with the chain 34. While the slip segments 13 hold against vertical movement, rotational movement is prevented by pulling the chain 34 snug around the coupling, and the backup situation is then established so that the next joint of pipe can be brought into threaded engagement. This process is repeated until all the joints of pipe are added, both for casing, drill pipe and tubing.

Each threaded connection which is made in the foregoing is controllably made by control of the torque from the power tong unit 62. At the time of threading up, each connection is properly made so that their connections are sure, but not over stressed. Eventually, this approach is used to assemble the entire string of threaded pipes and that is true with all sizes including tubing and casing.

While the foregoing is directed to preferred embodiment, the scope thereof is determined by the claim which follow:

What is claimed is:

1. A rig floor pipe handling system comprising:

(a) a rig floor supported frame;

(b) a centrally located bowl aligned in said frame to enable an elongate string of threaded pipe sections to extend below said frame through said bowl wherein a set of slips positioned in said bowl grip and hold the weight of the pipe string;

(c) a releasable pipe clamp supported by said frame in an aligned position above said bowl to enable said clamp to clamp a pipe therein and hold the pipe string below said bowl against rotation; and (d) wherein a pipe joint held above the rig floor can be threaded to the pipe string by moving the pipe joint down and into mating contact with the pipe string held fixedly with respect to said frame.

2. The apparatus of claim 1 including a fluid pressured powered cylinder having an extending rod connected with said slips to move said slips into and out of pipe engagement.

3. The apparatus of claim 2 wherein said set of slips comprise wedge shaped slips for fitting in the bowl and at least two of said slips include replaceable pipe gripping inserts having a rough surface for pipe engagement.

4. The apparatus of claim 3 wherein at least two of said of slips are arranged to form encircling and gripping contact around the pipe, and said inserts extend against the surface of the pipe and said slips hold said inserts in a gripping relationship against the pipe.

5. The apparatus of claim 1 including a planar, horizontal, mounting plate under said releasable pipe clamp to provide a base therefor.

6. The apparatus of claim 5 wherein said plate is supported for relative movement upwardly and downwardly with respect to said frame and movement is provided by a fluid pressure operated piston and cylinder construction.

7. The apparatus of claim 5 wherein said plate supports a horizontally moveable fluid pressure operated cylinder moving a rod for operation of said releasable clamp.

8. The apparatus of claim 5 wherein said clamp comprises an elongate chain formed of multiple links deployed to extend in an encircling fashion around a pipe to be clamped thereby.

9. The apparatus of claim 8 wherein said chain has two ends which are grasped and pulled to define a bight around the pipe and to enable the chain to be pulled tight.

10. The apparatus of claim 8 further including a chain guard on the exterior of said chain.

11. The apparatus of claim 8 including a pair of V-positioned plates having surfaces for contact against the pipe cooperative with a bight pulled in the chain around the pipe.

12. The apparatus of claim 11 wherein said chain forms a bight extending beyond the edge of said mounting plate.

13. The apparatus of claim 12 wherein said chain cooperates with said V-shaped plates to grasp a pipe therein at the coupling to enable the pipe coupling to be held against rotation.

14. The apparatus of claim 5 wherein said plate is supported for movement upwardly and downwardly by an upstanding post passing through a telescoping sleeve joined to said plate and said sleeve and post provide guided vertical movement.

15. The apparatus of claim 14 wherein said telescoping sleeve is located at one end of said plate and said plate has an opposite end wherein said chain for said releasable pipe clamp extends therebeyond to engage the pipe.

16. The apparatus of claim 15 wherein said chain comprises two chain ends connected to links in turn connected to a hydraulic powered ram for movement of said chain ends to thereby tighten the chain.

17. A method of threading and unthreading joints in a pipe string wherein the method comprises the steps of:

(a) positioning a rig floor supported frame in alignment above the well borehole;

(b) guiding a string of threaded pipe sections axially through a bowl below the pipe to thereby enable the addition of or deletion of a topmost pipe section to the string;

(c) securing the weight of the string by gripping the string on the exterior at an exposed area with a set of slips in the bowl to thereby prevent vertical movement;

(d) extending a releasable chain around the pipe to pull snug against the pipe so that the pipe is gripped;

(e) moving the chain with respect to the frame into engagement and out of engagement with the pipe to thereby grip and release controllably the pipe from the chain; and (f) holding the string against vertical movement and simultaneously holding the string against rotational movement to thereby enable an overhead supported pipe section to be threaded into or unthreaded from the string.

* * * * *